US007913604B2

(12) United States Patent
Monteil et al.

(10) Patent No.: US 7,913,604 B2
(45) Date of Patent: Mar. 29, 2011

(54) MISSILE CONTAINER RETAINING STRUCTURE FOR A VERTICAL MISSILE LAUNCH DEVICE

(75) Inventors: Dominique Monteil, Ruelle (FR); Hervé Bruneau, Champniers (FR)

(73) Assignee: DCNS, Paris (FR)

( * ) Notice: Subject to any disclaimer, the term of this patent is extended or adjusted under 35 U.S.C. 154(b) by 351 days.

(21) Appl. No.: 12/137,826

(22) Filed: Jun. 12, 2008

(65) Prior Publication Data

US 2009/0031887 A1 Feb. 5, 2009

(30) Foreign Application Priority Data

Jun. 13, 2007 (FR) ..... 07 55742

(51) Int. Cl.
*F41F 3/04* (2006.01)

(52) U.S. Cl. ..... 89/1.816; 89/1.8; 89/1.817; 89/1.819

(58) Field of Classification Search ..... 89/1.8, 89/1.816, 1.817, 1.819, 1.82; 52/793.1, 793.11, 52/649.1, 650.1
See application file for complete search history.

(56) References Cited

U.S. PATENT DOCUMENTS

| | | | | |
|---|---|---|---|---|
| 3,357,305 | A | 12/1967 | Clutz et al. | |
| 3,708,563 | A * | 1/1973 | Sells | 264/46.5 |
| 3,742,813 | A * | 7/1973 | Kongelbeck | 89/1.807 |
| 5,058,481 | A * | 10/1991 | Drummond et al. | 89/1.816 |
| 5,115,711 | A * | 5/1992 | Bushagour et al. | 89/1.816 |
| 5,153,367 | A * | 10/1992 | Markquart et al. | 89/1.816 |
| 5,847,307 | A | 12/1998 | Kennedy et al. | |
| 5,942,713 | A * | 8/1999 | Basak | 89/1.816 |
| 6,125,734 | A | 10/2000 | Yagla | |
| 6,135,666 | A * | 10/2000 | Kelly et al. | 403/256 |
| 6,230,604 | B1 * | 5/2001 | Larson et al. | 89/1.817 |
| 6,286,289 | B1 * | 9/2001 | Powell et al. | 52/790.1 |
| 6,634,541 | B1 * | 10/2003 | Hankey et al. | 228/135 |
| 6,868,769 | B1 * | 3/2005 | Wright | 89/1.811 |
| 2003/0000371 | A1 * | 1/2003 | Ciappi | 89/1.817 |
| 2003/0089220 | A1 * | 5/2003 | Boudreau et al. | 89/1.815 |
| 2004/0140341 | A1 * | 7/2004 | Moser et al. | 228/135 |
| 2005/0132873 | A1 * | 6/2005 | Supisiche et al. | 89/36.01 |
| 2006/0021497 | A1 * | 2/2006 | Paul et al. | 89/1.815 |
| 2007/0006722 | A1 * | 1/2007 | Dekel | 89/1.817 |
| 2007/0130873 | A1 * | 6/2007 | Fisher | 52/596 |
| 2008/0282875 | A1 * | 11/2008 | Mercier | 89/1.819 |

FOREIGN PATENT DOCUMENTS

| | | |
|---|---|---|
| EP | 0473498 | 3/1992 |
| FR | 2873197 | 1/2006 |

OTHER PUBLICATIONS

Search report in corresponding French Application No. 0755742, filed Jun. 13, 2007.

* cited by examiner

*Primary Examiner* — J. W Eldred
*Assistant Examiner* — Gabriel J Klein
(74) *Attorney, Agent, or Firm* — Young & Thompson

(57) ABSTRACT

The invention relates to a missile container retaining structure (1*a*) for a missile launch device of the type comprising a plurality of cells for receiving a missile container (2) and at least one duct (3). The structure is constituted by metal plates (101, 104) which are pre-cut so as to comprise complementary elements which can be fitted one inside the other, the plates being assembled so that the complementary elements of two adjacent plates are fitted one inside the other.

17 Claims, 3 Drawing Sheets

MISSILE CONTAINER RETAINING STRUCTURE FOR A VERTICAL MISSILE LAUNCH DEVICE

The present invention relates to a missile container retaining structure for a missile launch device, in particular a vertical missile launch device which is capable of being installed on board a vessel.

Vertical missile launch systems are known in which the missiles are stored vertically in containers which are arranged in container retaining structures which comprise a plurality of cells, some cells being intended to receive missile containers and other cells being intended to receive discharge conduits for the propulsion gas of the missiles.

Generally, devices of this type are constituted by a missile container retaining structure which comprises, at the upper portion thereof, an upper retaining and guiding plate which comprises openings opposite each of the cells of the container retaining structure and gas discharge openings, these openings being able to be closed by means of appropriate doors. At the lower portion thereof, the container retaining structure rests via a lower plate which is perforated with holes on a vessel for receiving the combustion gases which communicates with discharge ducts which extend between the cells for receiving the missile containers.

The container retaining structure must have an adequate level of geometric precision and strength in order to achieve correct positioning of the containers and correct guiding when the missiles are launched. One of the parameters used by missile guiding systems is an item of reference data relating to the vertical launch device. It is therefore essential that the geometry of this device and the positioning of the missiles inside this device are complied with to a very high level of precision and are accurate relative to a mean position. In particular, it is desirable for the angular deviation in all directions not to be greater than 0.5 milliradians.

In such vertical missile launch systems, the missile container retaining structure is a metal grid-like structure whose bars are generally tubes which are assembled at connection points in order to form nodes. A structure of this type is quite well-suited to missiles which may be up to 5 metres in length.

However, with such grid-like structures, the geometric quality tolerances of the missile launch device cannot be complied with in a satisfactory manner when the devices are provided in order to launch larger missiles, such as missiles whose length may be up to 7 metres. In particular, these grid-like structures have inadequate lateral strength.

Furthermore, it is necessary to protect these devices from corrosion, in particular when they are intended to be fitted on vessels. The grid-like structures are sometimes difficult to protect in a satisfactory manner, in particular in the connection zones of the two tubes, that is to say, in the nodes of the grid-like structure.

Finally, it may be desirable to protect the environment of the vertical launch device from incidents which may occur with the missiles which it contains. These incidents may be either an explosion of the propulsion charge of a missile or the accidental explosion of the military charge carried by a missile. In order to achieve this protection, it is necessary to provide a large armouring structure around the launch device, which makes the assembly heavier.

The object of the present invention is to overcome these disadvantages by providing a missile container retaining structure which allows vertical missile launch devices to be produced which are capable of receiving large missiles, which is easier to protect from corrosion than known structures and which facilitates the positioning of armours.

To this end, the present invention relates to a missile container retaining structure for a missile launch device of the type comprising a plurality of cells for receiving a missile container and at least one duct, which structure is constituted by metal plates which are pre-cut so as to comprise complementary elements which can be fitted one inside the other, the plates being assembled so that the complementary elements of two adjacent plates are fitted one inside the other.

Preferably, the complementary elements which can be fitted one inside the other are of the tenon or mortise type.

Preferably, the two adjacent plates are fixedly joined together by means of welding along their connection line.

At least one plate may comprise at least one cut-out which forms an opening in order to reduce the weight of the structure.

In a preferred embodiment, the structure is constituted by two semi-structures which are arranged facing each other and which are fitted to each other.

Preferably, each semi-structure comprises a front plate which comprises a plurality of mortise lines, a separation plate arranged opposite the front plate, parallel with the front plate, the separation plate comprising a plurality of mortise lines opposite the mortise lines of the front plate, two lateral plates which comprise tenons and at least one sectioning plate which comprises tenons. The tenons of the lateral plates and the sectioning plate(s) are capable of fitting in the mortises of the front plate and the separation plate, the tenons of the lateral plates and the sectioning plate(s) which are intended to fit in the mortises of the separation plate being of sufficient length to extend beyond the separation plate in order to constitute wall elements for cells which are intended to receive ducts.

The ends of the tenons of a semi-structure which are intended to fit in a separation plate face the corresponding tenons of the other semi-structure and the two semi-structures are assembled by means of welding along the connection lines of tenons of one semi-structure and the other semi-structure.

At least one plate which constitutes the outer wall of the container retaining structure may be capable of constituting an armour.

The invention also relates to a device for vertically launching missiles which are contained in containers, of the type comprising at least one missile container retaining structure, an upper end plate, a reception vessel for the propulsion gas and discharge ducts for the propulsion gases, the container retaining structure being in accordance with the present invention. This device may comprise one or more superimposed structures, at least one structure may be constituted by two assembled semi-structures. At least one of the structures may comprise external walls which are capable of constituting an armour.

It should be noted that the protection against corrosion for a device which is constituted by assembled plates is considerably facilitated compared with grid-like structures. This structure which is constituted by assembled plates has no obtuse reflex angle as may be found in the nodes of a grid-like structure and consequently it is easier to deposit means for protection against corrosion in the connection zones between two abutting plates rather than at the connection zone of the various bars of a grid-like structure.

Furthermore, in this structure, solid plates may be provided in at least some portions in materials which are sufficiently thick and sufficiently strong to be able to constitute armours. In this manner, with this structure, it is possible to obtain missile container retaining structures in which the armours are integrated in the container retaining structure. This is an advantage which allows the structure of the vessel which is intended to receive such a missile launch device to be simplified.

The invention will now be described in a more precise but non-limiting manner with reference to the appended Figures, in which.

Figure 1:
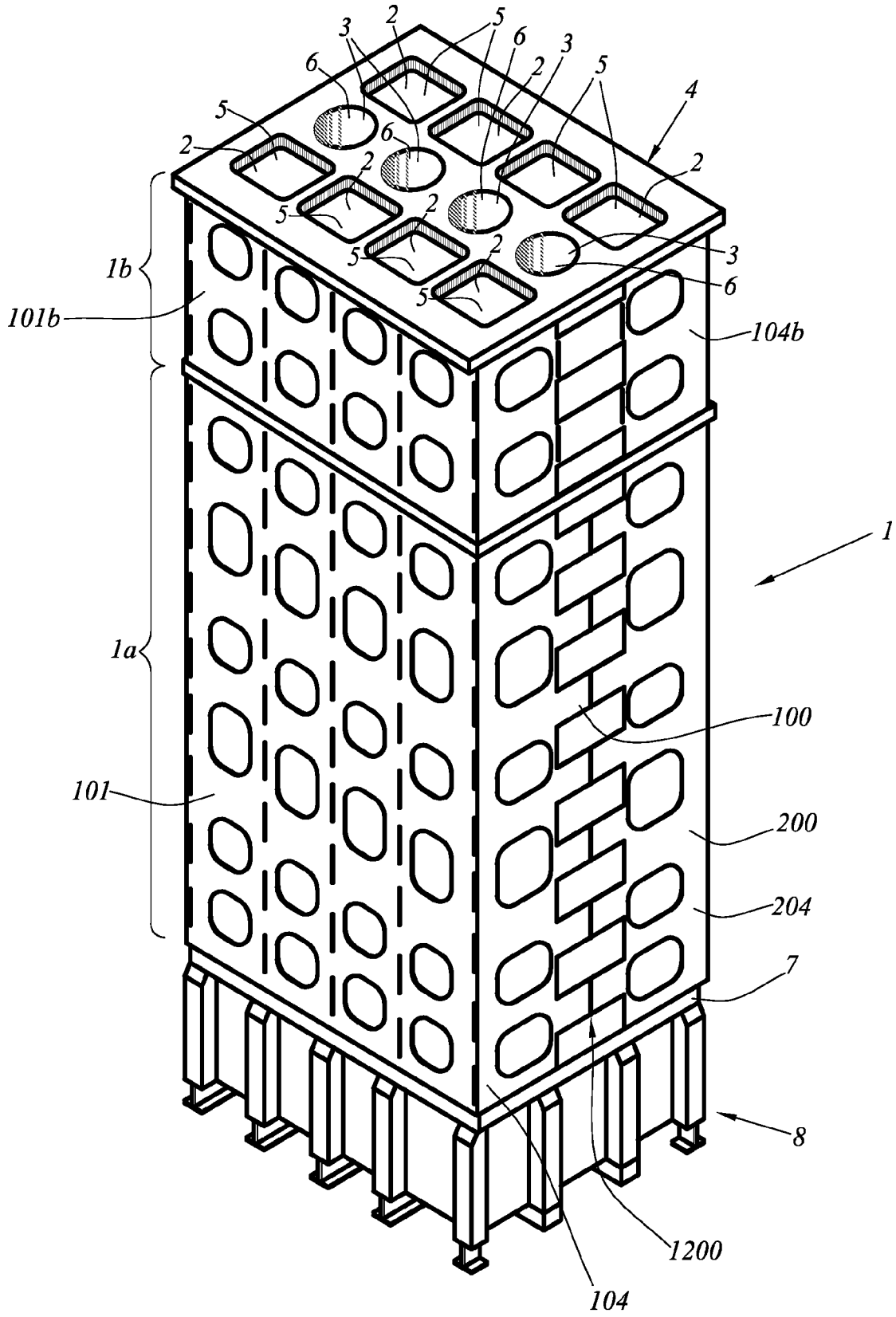
FIG. 1 is a perspective view of a vertical missile launch device.

The missile launch device illustrated in FIG. 1 comprises a missile container retaining structure 1 in which there are provided cells 2 for receiving missile containers and cells 3 which are intended to receive ducts for discharging the propulsion gases of the missiles when the missiles are launched. The cells for receiving missile containers are arranged so as to form two rows of adjacent cells which are arranged at one side and the other side of a row of cells 3 which are intended to receive ducts. The missile container retaining structure 1 is closed at the upper portion thereof by an upper plate 4 which comprises a plurality of openings 5 in which the cells 2 for receiving the missile containers open and openings 6 in which cells 3, which are intended to receive the discharge ducts for the propulsion gases, open.

At the lower portion thereof, the missile container retaining structure 1 rests on a base plate 7 which, in the same manner as the upper plate 4, comprises openings in which the cells for receiving missile containers and the cells for passage of the ducts open. This plate 7, which cannot be seen in the Figure, is supported on a vessel 8 for receiving the propulsion gases of the missiles and is in communication, on the one hand, with the cells for storage of the missile containers and, on the other hand, with the cells for discharging the propulsion gases. Since the upper plates, the gas plates and the vessel for receiving the combustion gases and the ducts are known per se, only the missile container retaining structure will be described below.

The missile container structure designated 1 in FIG. 1 is constituted by a main structural element 1*a* and a connection element 1*b* which is arranged on the main structural element 1*a* and which is intended to receive the upper plate 4. These structures are constituted in particular by lateral plates 101, 104, 204, 101*b*, 104*b* which are cut and assembled and plates which are located inside the structures and which cannot be seen in the Figure. This architecture comprising a plurality of portions is intended to facilitate the production but is not indispensable. Furthermore, since the construction methods of these modules use the same principles, that is to say, the assembly of plates comprising complementary cut-outs fitting one inside the other, only the main element will be described in detail.

The main structural element 1*a* is constituted by two semi-structures 100, 200 which are preferably mutually symmetrical and which are arranged so as to face each other and co-operate along the central plane of symmetry.

As will be described in greater detail below, each of these structures is constituted by metal plates which are cut so as to have cut-outs which are capable of being able to fit one inside the other in order to constitute plate assemblies. These plate assemblies are further strengthened by means of welding along connection lines of two abutting plates.

Since the two semi-structures 100 and 200 are constructed in the same manner, only the semi-structure 100 will be described below.

The semi-structure 100 is constituted by a front plate 101, a separation plate 102 which is arranged facing the front face and parallel therewith, two lateral plates 103 and 104 which are arranged at one side and the other of the lateral edges 105 and 106 of the front plate 101 and lateral edges 107 and 108 of the separation plate 102. The semi-structure also comprises three identical sectioning plates 109*a*, 109*b*, 109*c* which are parallel with the lateral plates. After assembly, the various plates delimit cells having a rectangular or square cross-section and half-cells which extend over the entire length of the structure.

The front plate 101 comprises along its lateral edges 105 and 106 cut-outs in the form of elongate openings 1010 in order to constitute mortise lines 1011 and 1012 which extend over the entire height of the front plate 101. The front plate 101 also comprises a plurality of mortise lines 1013*a*, 1013*b*, 1013*c* which extend vertically and which are located along the vertical delimitation lines between two successive cells. Furthermore, in the spaces which are located between two adjacent mortise lines, the plate may comprise openings 1014 which are intended to open up the structure in order to reduce its weight. These openings may have different shapes and sizes. In particular, they may have sizes which decrease from top to bottom in order to produce an "isostress" beam. Finally, the openings are selected in order to facilitate the assembly of secondary equipment on the structure.

Generally, the separation plate 102 comprises cut-outs 1020 which constitute vertical mortise lines 1021 and 1022 on the edges and 1023*a*, 1023*b* and 1023*c* in the central portion, as in the case of the front plate, and optionally weight-reduction openings 1024 which are comparable to the weight-reduction openings which are provided on the front plate. The vertical alignments of mortises which are provided on the separation plate are arranged so as to face the mortise lines which are provided on the front plate, that is to say, in positions which precisely delimit the different cells. The separation plate and the front plate may be identical. However, this does not necessarily have to be the case. The important aspect is that the vertical mortise lines of the two plates face each other. On the other hand, it is not necessary for the mortises of the separation plate all to face the mortises of the front plate.

Figure 3:
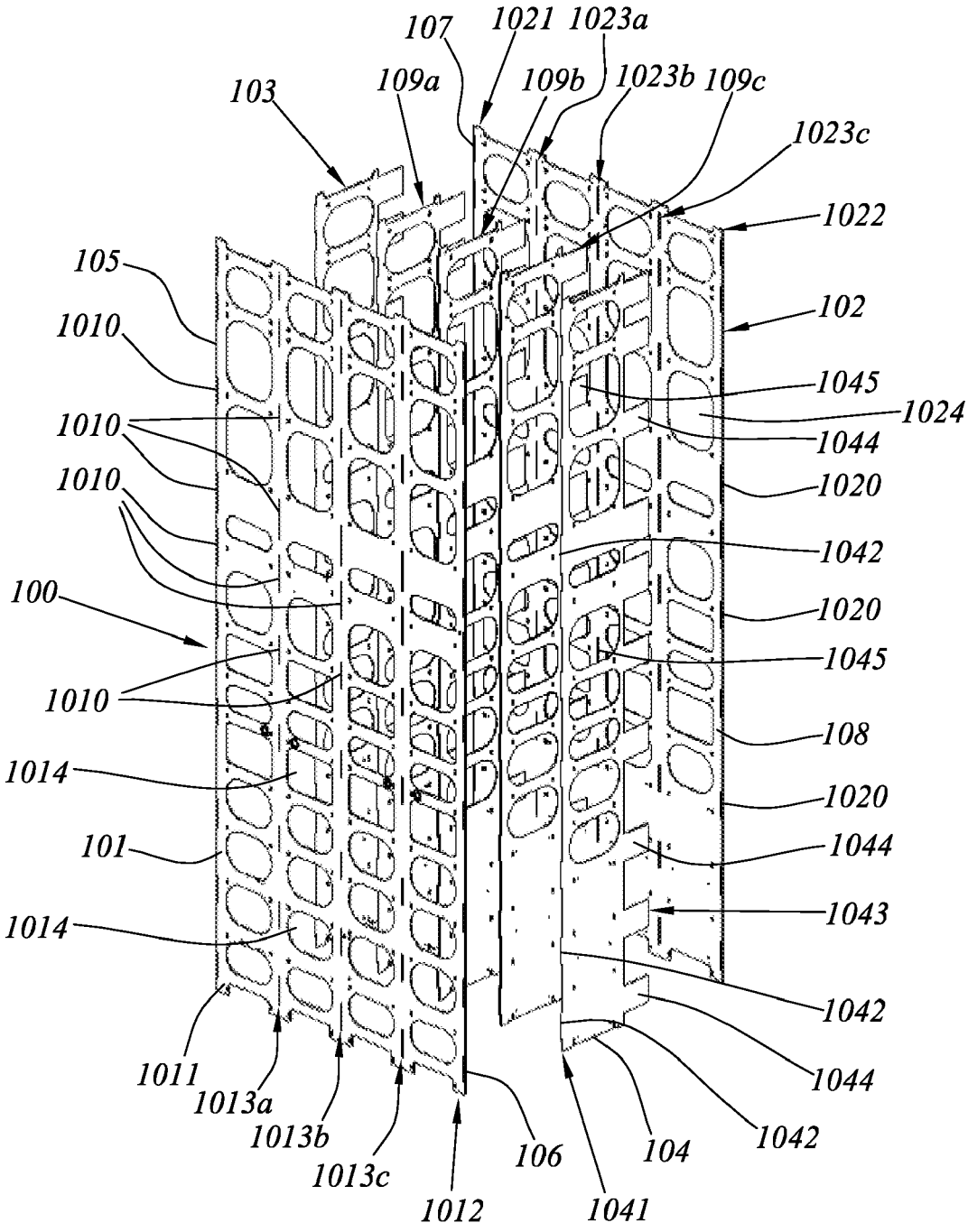
FIG. 3 is an exploded view of the semi-structure of FIG. 1.

The lateral plates 103 and 104 and the sectioning plates 109*a*, 109*b*, 109*c* have identical shapes. Therefore, only one of these plates will be described. As illustrated in FIG. 3, the plate 104 comprises, at one of the edges 1041 thereof, a plurality of cut-outs which constitute tenons 1042 which are capable of fitting in the mortises of the mortise alignment 1012 provided in the front plate 101. These tenons have lengths which are slightly greater than the thickness of the front plate in order to protrude sufficiently to allow weld seams to be produced in order to fixedly join the assembly together. At the opposing edge 1043, the plate 104 comprises a plurality of tenons 1044 which are long and which are capable of extending over the mortises of the mortise alignment 1022 provided in the separation plate 102 and so as to be able to extend beyond the separation plate 102 in order to form wall elements of cells which are intended to receive ducts. In the central body thereof, the plate 104 comprises a plurality of openings 1045 which are intended to reduce the weight. These openings 1045 are located between the front plate 101 and the separation plate 102.

Figure 2:
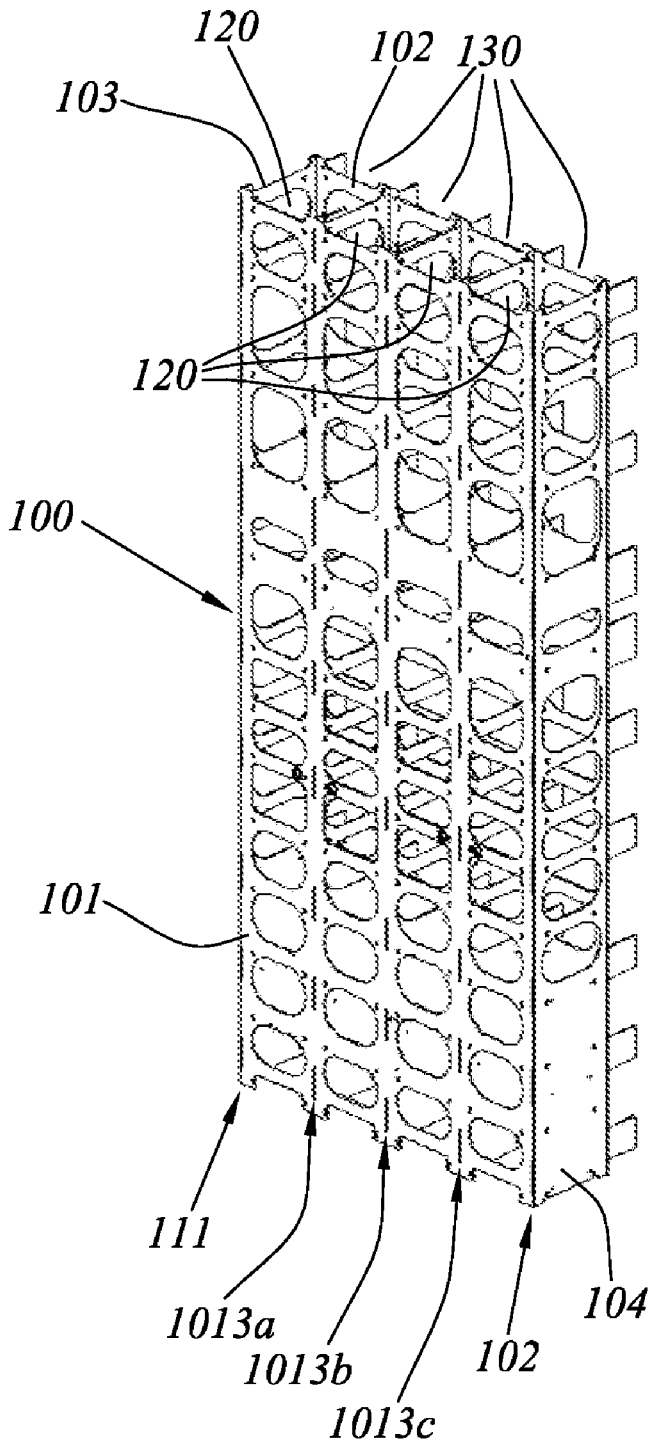
FIG. 2 is a perspective view of a semi-structure for retaining missile containers for the vertical launch device of FIG. 1.

As can be seen in FIG. 2, the front plate 101, the separation plate 102, the lateral plates 103 and 104 and the sectioning plates 109*a*, 109*b* and 109*c* are assembled in order to constitute an assembly which comprises four cells 120 which are intended to receive missile containers and four half-cells 130 which are intended to receive ducts.

In order to carry out this mounting, the lateral plates 103, 104 and the sectioning plates are fitted to the separation plate 102 so that the large tenons of the lateral plates and the sectioning plates extend significantly beyond the separation plate 102 in order to constitute wall elements of the half-cells 130. Then, the front plate 101 is arranged so that its mortise lines 1011, 1012 and 1013*a*, 1013*b*, 1013*c* fit on the small tenons 1042 of the sectioning plates, the lateral plates 103 and 104. Once assembled in this manner, the plates form an assembly which has very good geometric qualities and a good level of strength. In order to complete the assembly of these plates, weld seams are produced along the connection lines of the adjacent plates, that is to say, the lines defined by the fittings of the tenons in the mortises.

When two semi-structures of this type are produced, these two semi-structures are arranged one facing the other so that the elongate tenons of one of the structures face the elongate tenons of the symmetrical structure. These tenons come into contact with each other and the two semi-structures are assembled by means of welding along their connection lines, such as the line designated 1200 in FIG. 1.

The plates which are provided in order to produce this structure are steel plates which have a thickness of a few millimeters and which can be up to 8 mm or even more if required. They are pre-cut using precision cutting means such as water jet cutting or laser cutting. When these plates are assembled, the welding can be carried out either by means of arc welding with or without a filler metal or using techniques of welding by means of laser or electronic bombardment.

It should be noted that the structure which has been described above is produced using plates which comprise openings which are intended for cut-outs in the form of an opening which are intended to reduce the weight of the structure. If necessary, however, the plates may either comprise no large openings or comprise only small openings in order to be able to constitute armours. In this instance, when it is not necessary to have a large armour over the entire height of the structure, the plates may also be composite plates which are constituted by two portions of different thicknesses and which are assembled by means of welding in order to constitute a thick portion which provides the armouring function without making the assembly unnecessarily heavy. Such armours may be advantageous in order to protect the missiles from external aggressions but in particular to be able to protect the exterior from incidents which may occur with the missiles. Such incidents are, for example, untimely explosions of the propulsion means or untimely explosions of the military charges of the missiles.

In the example described, the missile container retaining structure comprises two rows of four cells which are intended to receive missile containers. However, the person skilled in the art will appreciate that the device may comprise fewer cells or, conversely, may comprise more.

Furthermore, the structure which has been described above is a structure in which the metal sheets have been cut with tenons and mortises in order to be able to form rigid assemblies. However, the person skilled in the art will appreciate that other cut-outs which have complementary shapes which are intended to fit one inside the other may be envisaged by a person skilled in the art.

Finally, the structure which has been described above can be used in a state mounted vertically under the deck of a vessel but may also be installed in other installations and, for example, terrestrial installations, or optionally mobile installations.

The invention claimed is:

1. Missile container retaining structure (1) for a missile launch device having a plurality of cells for receiving a missile container (2) and at least one duct (3), the retaining structure comprising:

metal plates (101, 101*b*, 102, 103, 104, 104*b*, 109*a*, 109*b*, 109*c*, 204) which are pre-cut to include complementary elements (1010, 1020, 1042, 1044) that can be fitted one inside the other, the plates being assembled so that the complementary elements of two adjacent plates are fitted one inside the other; and two semi-structures (100, 200) that are arranged facing each other and that are fitted to each other, wherein each semi-structure (100) is constituted by a front plate (101), which comprises a plurality of mortise lines (1011, 1012, 1013*a*, 1013*b*, 1013*c*), a separation plate (102) arranged opposite the front plate and parallel with the front plate, the separation plate (102) comprising a plurality of mortise lines (1021, 1022, 1023*a*, 123*b*, 123*c*) opposite the mortise lines of the front plate, two lateral plates (103, 104) which comprise tenons (1042, 1044) and at least one sectioning plate (109*a*, 109*b*, 109*c*) which comprises tenons, the tenons (1042, 1044) of the lateral plates and the sectioning plate(s) fitting in the mortises (1010, 1020) of the front plate and the separation plate, the tenons (1044) of the lateral plates and the sectioning plate(s) which fit in the mortises (1020) of the separation plate being of sufficient length to extend beyond the separation plate in order to constitute wall elements for cells which are intended to receive ducts.

2. The retaining structure according to claim 1, wherein the complementary elements (1010, 1020, 1042, 1044), which can be fitted one inside the other, are of the tenon and mortise configuration.

3. The retaining structure according to claim 1, wherein two adjacent plates (101, 101*b*, 102, 103, 104, 104*b*, 109*a*, 109*b*, 109*c*, 204) are fixedly joined together by means of welding.

4. The retaining structure according to claim 1, wherein at least one plate (101, 102, 104) comprises at least one cut-out (1014, 1024, 1042) which forms an opening.

5. The retaining structure according to claim 1, wherein the ends of the tenons (1044) of a semi-structure (100) fit in a separation plate (102) face of the corresponding tenons of the other semi-structure (200), and the two semi-structures (100, 200) are assembled by means of welding along the connection lines (1200) of tenons of one semi-structure and the other semi-structure.

6. The retaining structure according to claim 1, wherein at least one plate, which constitutes the outer wall of the container retaining structure, is capable of constituting an armour.

7. A device for vertically launching missiles, which are contained in containers, comprising at least the missile container retaining structure (1*a*, 1*b*) in accordance with claim 1, and including an upper end plate (4), a reception vessel (8) for the propulsion gas and discharge ducts (3) for the propulsion gases.

8. A device for vertically launching missiles, which are contained in containers, comprising at least the missile container retaining structure (1*a*, 1*b*) in accordance with claim 1, and including a reception vessel (8) for the propulsion gas and discharge ducts (3) for the propulsion gases.

9. A device for vertically launching missiles, which are contained in containers, comprising at least the missile container retaining structure (1*a*, 1*b*) in accordance with claim 6, and including an upper end plate (4), a reception vessel (8) for the propulsion gas and discharge ducts (3) for the propulsion gases.

10. The retaining structure according to claim 2, wherein two adjacent plates (101, 101*b*, 102, 103, 104, 104*b*, 109*a*, 109*b*, 109*c*, 204) are fixedly joined together by means of welding.

11. The retaining structure according to claim 2, wherein at least one plate (101, 102, 104) comprises at least one cut-out (1014, 1024, 1042) which forms an opening.

12. The retaining structure according to claim 2, wherein at least one plate, which constitutes the outer wall of the container retaining structure, is capable of constituting an armour.

13. A device for vertically launching missiles, which are contained in containers, comprising at least the missile container retaining structure (1*a*, 1*b*) in accordance with claim 2, and including an upper end plate (4), a reception vessel (8) for the propulsion gas and discharge ducts (3) for the propulsion gases.

14. A device for vertically launching missiles, which are contained in containers, comprising at least the missile container retaining structure (1*a*, 1*b*) in accordance with claim 3, and including an upper end plate (4), a reception vessel (8) for the propulsion gas and discharge ducts (3) for the propulsion gases.

15. A device for vertically launching missiles, which are contained in containers, comprising at least the missile container retaining structure (1*a*, 1*b*) in accordance with claim 4, and including an upper end plate (4), a reception vessel (8) for the propulsion gas and discharge ducts (3) for the propulsion gases.

16. A device for vertically launching missiles, which are contained in containers, comprising at least the missile container retaining structure (1*a*, 1*b*) in accordance with claim 1, and including discharge ducts (3) for the propulsion gases.

17. A device for vertically launching missiles, which are contained in containers, comprising at least the missile container retaining structure (1*a*, 1*b*) in accordance with claim 5, and including an upper end plate (4), a reception vessel (8) for the propulsion gas and discharge ducts (3) for the propulsion gases.

* * * * *